US007503400B2

(12) United States Patent
Llewellyn

(10) Patent No.: US 7,503,400 B2
(45) Date of Patent: Mar. 17, 2009

(54) TWO SHOT POWER NAILER

(75) Inventor: Dan Llewellyn, Woodcliff Lake, NJ (US)

(73) Assignee: Arrow Fastener Co., Inc., Saddle Brook, NJ (US)

( * ) Notice: Subject to any disclaimer, the term of this patent is extended or adjusted under 35 U.S.C. 154(b) by 848 days.

(21) Appl. No.: 10/768,377

(22) Filed: Jan. 30, 2004

(65) Prior Publication Data

US 2005/0167465 A1 Aug. 4, 2005

(51) Int. Cl.
*B25D 11/00* (2006.01)

(52) U.S. Cl. ..... 173/117; 173/118; 173/121

(58) Field of Classification Search ..... 173/52, 173/114, 117, 118, 121; 227/131, 132; 310/12–39
See application file for complete search history.

(56) References Cited

U.S. PATENT DOCUMENTS 2,861,778 A * 11/1958 Spurlin ..... 173/117
3,924,789 A * 12/1975 Avery et al. ..... 227/131
4,015,671 A * 4/1977 Borisov et al. ..... 173/117
4,243,899 A * 1/1981 Jaffe ..... 310/14
4,293,088 A * 10/1981 Barrett et al. ..... 227/131
4,515,303 A 5/1985 Schadlich et al.
4,565,313 A * 1/1986 Buck et al. ..... 227/131
4,799,557 A * 1/1989 Jacquemet ..... 173/91
4,946,087 A 8/1990 Wingert
5,760,552 A * 6/1998 Chen et al. ..... 318/122
6,364,193 B1 * 4/2002 Tsai ..... 227/131
6,854,530 B1 * 2/2005 Yiu ..... 173/1
2002/0014344 A1 2/2002 Geiger et al.
2002/0079111 A1 * 6/2002 Camp ..... 173/217
2005/0045352 A1 3/2005 Yiu

OTHER PUBLICATIONS

International Search Report, Mar. 31, 2005.

* cited by examiner

*Primary Examiner*—Paul R Durand
(74) *Attorney, Agent, or Firm*—Leon E. Redman; Carlson, Gaskey & Olds

(57) ABSTRACT

A nail gun includes a power coil for moving a plunger in two opposed directions. The plunger is first moved away from a nail, and force from this movement is stored in a force storage mechanism. The plunger is then driven by the coil in an opposed direction, and the force stored within the forced storage mechanism is released, such that the released force and the power force from the coil are combined to drive a nail into a work piece.

7 Claims, 3 Drawing Sheets

TWO SHOT POWER NAILER

BACKGROUND OF THE INVENTION

This invention relates to a power nailer, wherein a drive motor force is combined with a prestored mechanical force at the time of drive actuation.

Power nailers are utilized to drive a nail into a work piece. As known, a motor drives a plunger, and the plunger carries a blade that drives the nail into the work piece. It is desirable to provide a significant amount of drive force to drive the nail. However, there are also size, weight and cost limitations that prevent simply providing a very powerful motor.

As such, it would be desirable to provide greater force in a smaller package for a power nailer.

SUMMARY OF THE INVENTION

In a disclosed embodiment of this invention, a mechanical force storage element stores a force, which is then released in combination with a drive actuation force from a motor for a power nailer. In a preferred embodiment, the force storage is provided by initially driving a plunger in a first direction to compress a spring, storing the force. Once the spring is compressed, a separate drive motor force drives the plunger in an opposed direction, combining the release of the spring with the drive motor force.

In a broad description, the present invention provides a system wherein a plunger is moved in a first direction, and some of the energy from that movement is stored. The plunger is then driven in a second direction by a drive force, combined with at least some of the stored energy.

In a preferred embodiment, a control for an electric coil first pulls the plunger rearwardly, compressing the spring. The control is programmed, and the spring is designed, such that a firing force is provided to drive the plunger in an opposed direction once the spring is compressed to a desired extent. Most preferably, the two firing forces for driving the plunger in the two opposed directions are selected to coincide with peaks in the power wave for the alternating current being provided to the coil.

In a second embodiment, the control includes a capacitor that stores a firing force as the plunger is being pulled rearwardly. A position sensor senses the position of the plunger, and when the plunger reaches its rearwardmost position, the capacitor is discharged to fire the plunger in the firing direction, and allow the spring to expand, providing additional force to drive the plunger.

In yet another embodiment, a simple, mechanical brake catches and holds the plunger as it is pulled through its first return stroke. When the plunger is driven through its drive stroke, the force of the brake is overcome, allowing an energy storage mechanism to release the stored energy to be combined into this drive stroke.

Since the present invention drives the plunger in two directions, but effectively stores the force from the first drive direction, and then combines that stored force with the second drive force, a greater force is provided with a relatively small, inexpensive package.

These and other features of the present invention can be best understood from the following specification and drawings, the following of which is a brief description.

DETAILED DESCRIPTION OF THE PREFERRED EMBODIMENT

Figure 1:
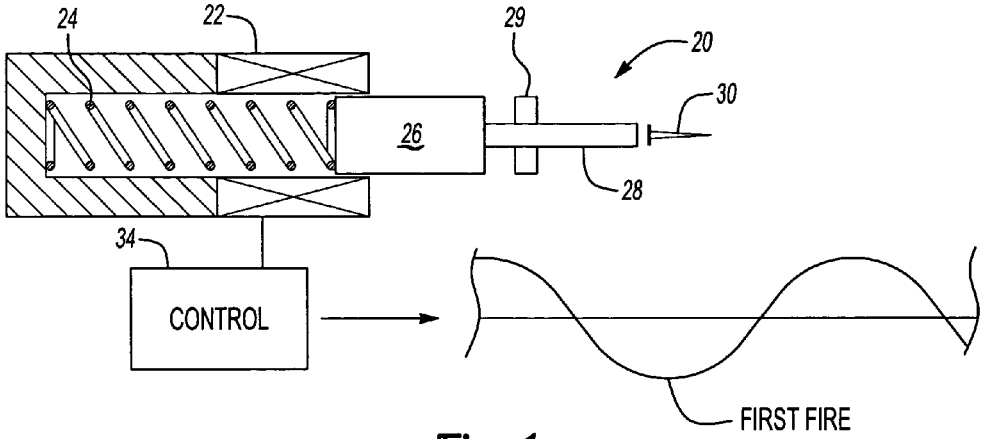
FIG. 1 is a schematic view of a first position for the inventive power nailer.

A power nailer 20 is illustrated schematically in FIG. 1 having a solenoid coil 22 positioned forwardly of a spring 24. A plunger 26 carries a firing blade 28 guided in a blade guide 29. As known, nails 30 are brought in front of blade 28 for firing into a work piece.

Control 34 for the coil 22 is controlled to actuate a first firing charge from the FIG. 1 position, as a power wave approaches a first peak. As the wave approaches a peak, the coil 22 is actuated, pulling the plunger 26 to the left, toward the spring 24.

Figure 2:
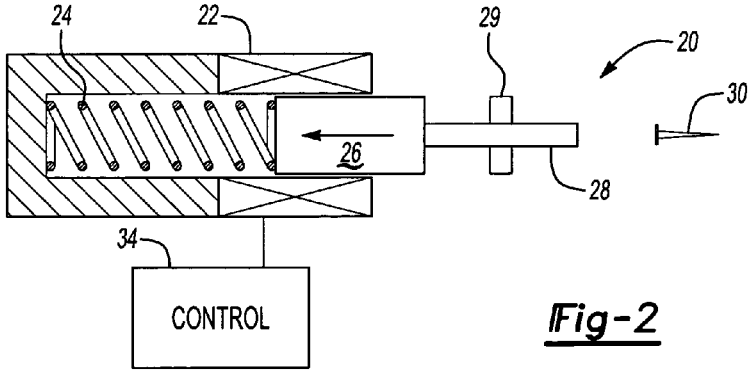
FIG. 2 shows the power nailer beginning its firing stroke.

As shown in FIG. 2, as the plunger 26 moves within the coil, the power to the coil is stopped before the plunger reaches the end of the coil. Essentially, the coil 22 will tend to center the plunger 26 and thus would resist movement of the plunger beyond the coil if the power to the coil were not stopped at some intermediate position such as shown in FIG. 2.

Figure 3:
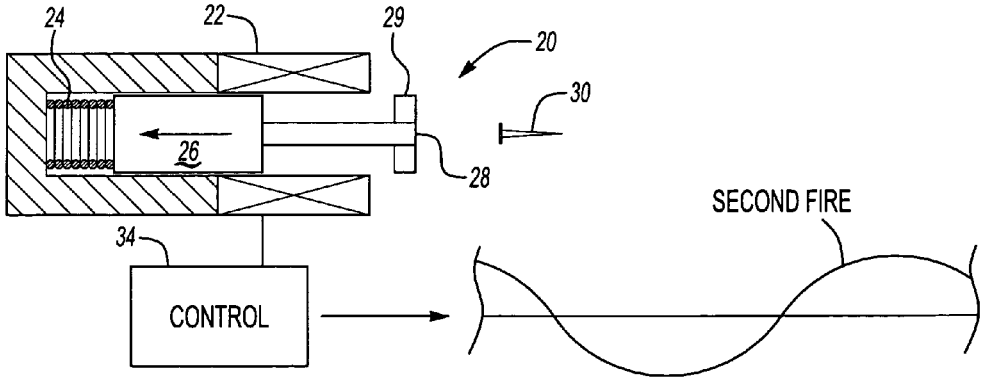
FIG. 3 is a position subsequent to the FIG. 2 position.

The momentum of the plunger 26 continues to carry it to the left after the power to the coil 22 is stopped. Plunger 26 thus compresses the spring 24 to a position such as shown in FIG. 3. It is a goal of this invention to achieve this compressed position at approximately the same time that the power curve again approaches a peak. Thus, the spring 24, and the strength of the coil 22 should be designed such that the momentum of the plunger 26 causes the spring 24 to be compressed to about its maximum compression point as the power curve approaches the position shown in FIG. 3. At that point, the coil 22 is again fired.

Figure 4:
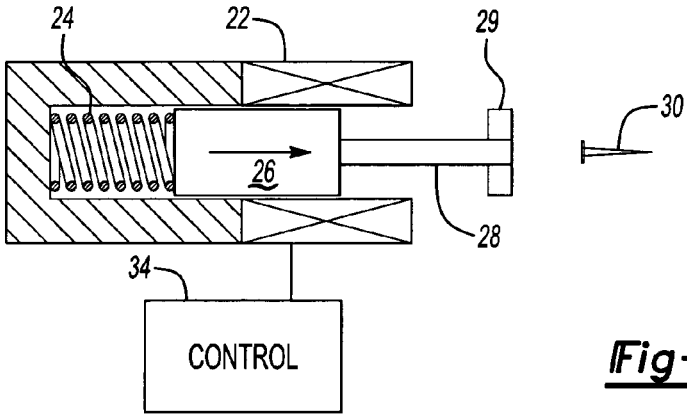
FIG. 4 is a position subsequent to the FIG. 3 position.

This second firing drives the plunger 26 back to the right, as shown in FIG. 4.

Figure 5:
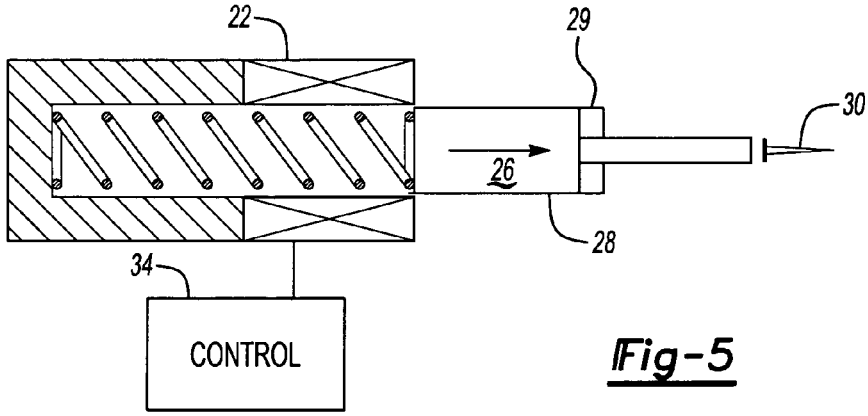
FIG. 5 is a position subsequent to the FIG. 4 position.

At some intermediate position such as shown in FIG. 4, power to the coil is again stopped. Eventually, the plunger 26 moves to the point where the blade 28 drives the nail 30 into the work piece as shown in FIG. 5. While springs are shown as being unconnected to the plunger, in fact one end of the spring can alternatively be secured to the plunger.

The present invention thus provides an invention wherein a relatively small coil effectively has its power doubled in that a first power stroke is stored in the spring 24, and later combined with a second power stroke. Thus, a relatively small and inexpensive package can still provide a good deal of drive force.

Figure 6:
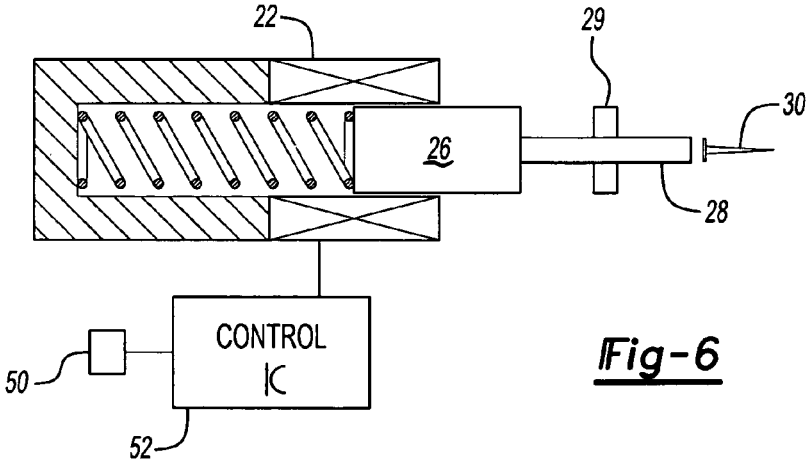
FIG. 6 shows a second embodiment.

FIG. 6 shows another embodiment wherein a capacitor is included in the control 52. When position sensor 50 senses that the plunger 26 is approaching its leftmost position, the capacitor is discharged, powering the coil 22 and driving the plunger back to the right, and driving nail 30. Thus, this embodiment does not require the spring design to be tuned to match the A/C power peak. Instead, much of this is simplified by including a position sensor to identify when the plunger reaches a particular position, and then driving the plunger to drive a nail. The capacitor is preferably charged after the nail has been driven in the second power stroke.

Figure 7:
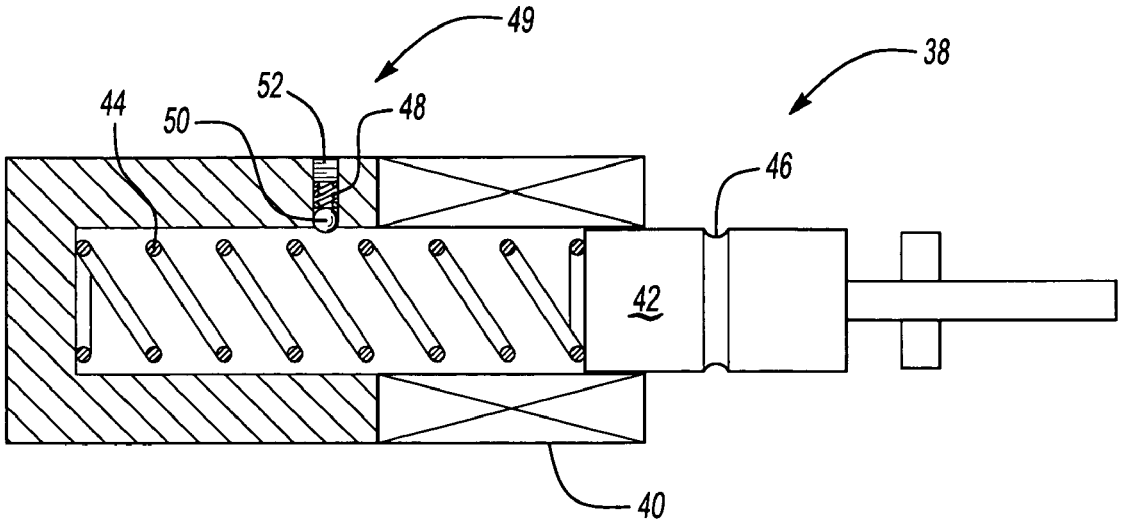
FIG. 7 shows a third embodiment.

As shown in FIG. 7, in another embodiment 38, a coil 40 drives plunger 42. Spring 44 is connected to the plunger 42. A groove 46 is formed in the plunger 42. A mechanical brake 49 is associated with a rear position of the embodiment 38. The mechanical brake 49 includes a ball 50 that is spring biased 48 toward a position where the plunger 42 will move. A set screw 52 is positioned outwardly of spring 48, and may be turned to adjust the tension in the spring 48.

Figure 8:
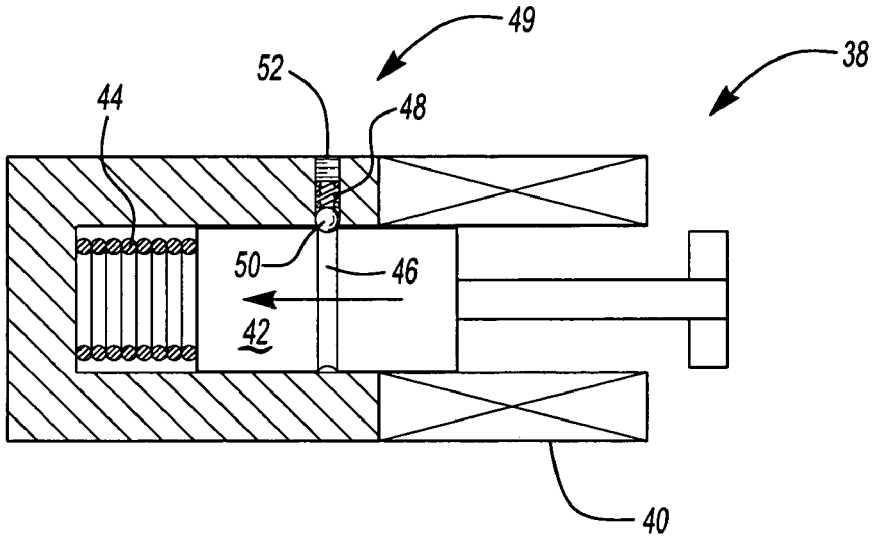
FIG. 8 shows the third embodiment in a position subsequent to the FIG. 7 position.

As shown in FIG. 8, when the plunger has been driven through its first stroke, the ball will snap into the groove 46, holding the plunger 42 at its withdrawn position.

When the coil 40 fires on its power stroke, the force of the spring 48 will be overcome, and the ball 50 will be driven outwardly of the groove 46, releasing the plunger 42. Spring 44 may then expand to add the stored energy to the power stroke.

The present invention thus provides embodiments wherein a relatively small coil can provide a relatively high drive force.

Although preferred embodiments have been disclosed, a worker of ordinary skill in this art would recognize that certain modifications would come within the scope of this invention. As an example, while a coil spring is illustrated, other force storage mechanisms may be substituted. Thus, the following claims should be studied to determine the true scope and content of this invention.

What is claimed is:

1. A device for driving an attachment element into a work piece comprising:

a first drive element for driving a plunger in a first direction away from an attachment element to be driven, and said plunger storing energy in an energy storage mechanism when moved in said first direction;

a second drive element to drive said plunger in a second direction opposed to said first direction, and release stored energy stored in said energy storage mechanism in combination with a power force from said second drive element to said plunger when moved in said second direction to drive an attachment element;

said first and second drive elements for moving said plunger in said first direction and in said second direction being the same drive element, said same drive element being an electric coil; and a position sensor for sensing a position of said plunger, a control receiving a signal from said position sensor when said plunger reaches a rearwardly spaced position, and driving said plunger in said second direction once said position sensor has identified said plunger as being in said rearwardly spaced position.

2. A device as set forth in claim 1, wherein said control further storing energy for driving said plunger in said second direction in a capacitor, and said energy being released after said position sensor indicates said plunger has reached said rearwardly spaced position.

3. A device as set forth in claim 1, wherein said coil tends to center said plunger within said coil, and said plunger first being positioned spaced toward the attachment element from a centered position, said plunger being pulled into said coil in said first direction and power to said coil being stopped before said plunger reaches a centered position, momentum carrying said plunger beyond said centered position; and against said force storage mechanism to transfer force to said force storage mechanism.

4. A device as set forth in claim 3, wherein said control and said force storage mechanism are designed such that said plunger stores energy in said force storage mechanism, and said power force is then initiated.

5. A device as set forth in claim 4, wherein said force storage mechanism is a coil spring.

6. A power nailer for driving a nail into a work piece comprising:

a plunger having a blade at a forward end, said plunger being guided within guides adjacent one end, and said blade being brought into contact with a nail received within said power nailing device;

a coil positioned to drive said plunger in a first and second direction;

a spring on an opposed side of said coil from said nail;

a coil for driving said plunger within said coil in a first direction, and away from said nail, said plunger moving to compress said spring, and transfer energy from said plunger to be stored in said spring, and said control then being operable to fire said coil to drive said plunger in said second direction such that a force on said plunger when moving in said second direction includes a force from said coil, and a force previously stored in said spring, said plunger then being brought into contact with said nail, driving said nail into a work piece; and a control receiving a signal from a position sensor when said plunger reaches a rearwardly spaced position, and driving the plunger in said second direction once said position sensor has identified said plunger as being in said rearwardly spaced position.

7. A power nailer as set forth in claim 6, wherein said control further storing energy for driving said plunger in said second direction in a capacitor, and said energy being released after said position sensor indicates said plunger has reached said rearwardly spaced position.

* * * * *